United States Patent [19]

Hirschhorn

[11] Patent Number: 4,899,504

[45] Date of Patent: Feb. 13, 1990

[54] BOLTED STEEL STAIRCASE

[76] Inventor: Richard S. Hirschhorn, Sterling Rd., Harrison, N.Y. 10528

[21] Appl. No.: 345,192

[22] Filed: Apr. 28, 1989

[51] Int. Cl.[4] ..... E04F 11/00

[52] U.S. Cl. ..... 52/182; 52/188; 52/191; 182/93

[58] Field of Search ..... 52/182–191; 182/93

[56] References Cited

U.S. PATENT DOCUMENTS

| | | | |
|---|---|---|---|
| 1,064,050 | 6/1913 | Brooks | 52/188 |
| 1,138,642 | 5/1915 | Dowling et al. | 52/191 X |
| 1,593,418 | 7/1926 | Berson | 52/191 |
| 1,660,392 | 2/1928 | Norberg | 52/188 |
| 1,676,317 | 7/1928 | Bennett | 52/188 |
| 1,771,405 | 7/1930 | Felsenthal | 52/191 |
| 2,105,565 | 1/1938 | Von Schantz | 52/191 |
| 2,555,002 | 5/1951 | Phillips et al. | 52/188 |
| 3,608,256 | 9/1971 | Jeffery's | 52/182 |
| 4,034,525 | 7/1977 | Yokomori | 52/188 |

*Primary Examiner*—Richard E. Chilcot, Jr.
*Attorney, Agent, or Firm*—Eliot S. Gerber

[57] ABSTRACT

A bolted steel staircase is erected by placing side stringers spaced apart and attached to the upper and lower floors. A series of stair pans are placed on brackets, the brackets having been welded to the stringers in the fabrication location. The nuts are then hand-tightened on bolts which are welded to the brackets. A set of flat metal wedges, each having an angled slot, is driven between the vertical bolts and lances on the sides of the stair pans in order to align the stair pans and drive them against the stringers. After the wedges are driven, the nuts are fully tightened.

7 Claims, 4 Drawing Sheets

BOLTED STEEL STAIRCASE

BACKGROUND OF THE INVENTION

1. Field of the Invention

The present invention relates to the fabrication of metal staircases.

2. Description of the Related Art

In commercial and industrial buildings, such as multi-story office buildings or multi-story factory buildings, the floors may be constructed of reinforced concrete. The distance from one floor to the next is often not uniform, so that the stairs are either a steel stairway, fabricated off the construction site, i.e., "off-site", or a concrete stairway, formed at the construction site, i.e., "on-site".

As used herein, the term "staircase" means the structure containing a stairs; "stairs" means a series of steps in a unitary structure; and "stairway" means one or more flights of staircases usually with connective landings. The present invention is particularly adapted for, and the illustrations are related to, a set of steps forming straight stairs between two adjoining floors. However, it may be utilized in the formation of stairways having landings.

Metal stairs are partially built in a fabrication plant, away from the construction site. Because the distance between floors varies from one building to another, and even within a single building, each metal staircase must be specially fabricated.

Basically, there are two types of metal staircases in commercial use, namely, bolted staircases and welded staircases. A widely used type of welded staircase uses stringers (elongated side members) to which brackets (carriers) are welded, generally in the steel fabrication off-site shop. One type of bracket uses a continuous ribbon for each stringer which is bent at right angles to form the supports for the stairs. The stairs are separately fabricated, off-site, with each stair comprising a pan (horizontal portion) and a riser (vertical portion). The complete metal stairway is assembled on-site with the stair pan being individually welded onto the stringer brackets. The assembly, prior to welding, must be done carefully, by skilled iron workers, who clamp the stringers and pans to correctly align them ("square up") before they are welded. If the staircase is incorrectly aligned, the welds must be ground away and re-welded. The welding should be performed by skilled workers as many of the welds are visible to those using the staircase. One series of welds is used to connect the riser to its adjacent tread. Even though, for appearance, those welds are made from the back of the riser, the heat of the weld causes distortion of the metal. That metal distortion is highlighted by the paint coating and detracts from the appearance of the staircase.

The alternative construction, of bolted metal staircases, is also widely used. In that construction, the stringers are pre-fabricated, off-site, by welding brackets to the stringers. The brackets have pre-formed holes to receive bolts. On site, the stringers are held in upright position and then the floor pans are placed in their positions one after the other, resting on the brackets and bolted down. Frequently the floor pans are forced into position by hammer blows as the previously positioned floor pans may draw the stringers together. At that time the staircase is mounted by the workers who are bolting it together, i.e., they build up from the bottom stair to the top stair. Each stair pan is aligned with its holes matching the holes of the bracket and the prior stair pan, using a guidance pin. In addition to the bolts at the sides, joining the stair pans with the brackets, additional bolts are required to join each stair pan with the riser of its adjoining stair pan. A typical staircase may require about 100–150 bolts, each of which must be correctly tightened to its nut. Some of the bolts are very difficult to reach, especially for a man doing the job alone. For example, the top bolts require two men, one on a ladder or else one man reaching over the stair from above. The bolting together of the stairway is time-consuming due to the location and number of the bolts. If the staircase is misaligned, frequently many bolts must be loosened, the staircase re-adjusted and the bolts re-tightened. Sometimes bolts, and their nuts, are lost or misplaced. Even so, mistakes are quicker and easier to correct in a bolted staircase than with a welded staircase. The force of the bolts, when they are being tightened, is generally sufficient to straighten the stringers and otherwise correctly align (square-up) the staircase.

After the metal staircase, either welded or bolted, is assembled, on-site, its stair pans are filled with concrete. The concrete will hide some, but not all, of the welds and bolts.

U.S. Pat. No. 4,285,177 entitled "Reinforced Tread Assembly" shows the use of glass fiber reinforced tread assemblies in a metal stairway system. U.S. Pat. Nos. 3,498,012 and 3,606,236 show a metal stairway system using prefabricated stair treads and locking devices to lock the stair treads to risers.

SUMMARY OF THE INVENTION

A metal structure is provided which is pre-fabricated in an off- site shop and assembled, by bolts, on site. The bolts are connected to the metal members and their nuts screwed loosely on the bolts, so there is no danger of loosening either the nuts or bolts. The joining members provide a broad tolerance, so that exact and time-consuming on-site alignment is not required.

On the site, the stringers are held erected, between the building floors, and all the pans are set in position, before being bolted down, which immediately permits the workers to walk the entire length of the staircase. The stair pans are held by hand-tightening the nuts. Then the stair pans are driven into their correctly aligned positions using wedges having an angled channel. Each wedge cams against the side of a lance (raised metal portion) so that driving the wedge forces the stair pan tightly against the stringers and the prior located stair pan. After the wedges are driven, by a special hammer device, the nuts are tightened on the bolts, which may be performed rapidly using a socket wrench. The wedges are placed in position in the shop and are left in place after assembly of the staircase.

OBJECTIVES AND FEATURES OF THE INVENTION

It is an objective of the present invention to provide an improved bolted metal staircase which may be erected by being bolted on-site with less time and labor, which reduces the fabrication time in the off-site shop, and which has a high quality appearance.

It is a further objective of the present invention to provide such a staircase in which the bolts and nuts cannot be lost or misplaced before they are tightened down.

It is a further objective of the present invention to provide such a staircase which will not have unsightly bolts or weld lines showing after the stair pans are filled with concrete.

It is a further objective of the present invention to provide such a staircase which, from the rear of the staircase, provides the quality appearance of two continuous lines of side brackets forming ribbon-like support brackets.

It is a further objective of the present invention to provide such a staircase which may be bolted by one man and which may be walked upon by those assembling the staircase, prior to the final nut-tightening operation.

It is a further objective of the present invention to provide the stair pans and other portions of the staircase prior to the final tightening of the nuts.

It is a further objective of the present invention to provide such a staircase which permits the use of stair pans which are slightly too short and yet, with such short pans, will still provide a correctly aligned staircase having tight joints.

It is a further objective of the present invention to provide such a staircase which provides a support of the nose (sub-tread and top lip) portion, at its center, to prevent bending of that portion before the concrete is poured.

It is a further objective of the present invention to provide such a staircase which may be easily and readily re-adjusted if the final inspection discloses some of the stair pans are improperly located, the stringers are not tight against the sides of the stair pans or the staircase is skewed.

It is a feature of the present invention to provide a bolted metal staircase including a pair of spaced apart and parallel side stringers, a plurality of horizontally aligned carrier brackets welded to each stringer, and a plurality of stair pans. Each of the stair pans has a horizontally aligned pan portion, to hold concrete, and a riser portion.

A pair of upwardly protruding lance means are formed on the pan portions. Each lance means is near an outer edge of the pan portion and proximate a stringer. A vertically aligned bolt having a shank portion is welded on the horizontal bracket. A flat plate steel wedge, having a side face and a slit angled relative to its side face, is positioned on the pan portion with the bolt shank portion within the slit and with the wedge side face in contact with the lance means. The wedge is driven in order to cam the pan portion toward the stringer.

Further features of the invention are that the lance means comprises a protruding portion stamped from the pan portion and having opposite support legs and a top portion; and a plurality of vertical brackets are fastened to each stringer with each vertical bracket having a horizontally aligned bolt welded thereto, each of the riser portions being fastened to two opposite-side vertical brackets by nuts threaded on the horizontal bolts.

BRIEF DESCRIPTION OF THE DRAWINGS

Other objectives and features of the present invention will be apparent from the following detailed description of a preferred embodiment, taken in conjunction with the accompanying drawings.

In the drawings.

DETAILED DESCRIPTION OF THE PREFERRED EMBODIMENT

Figure 2:
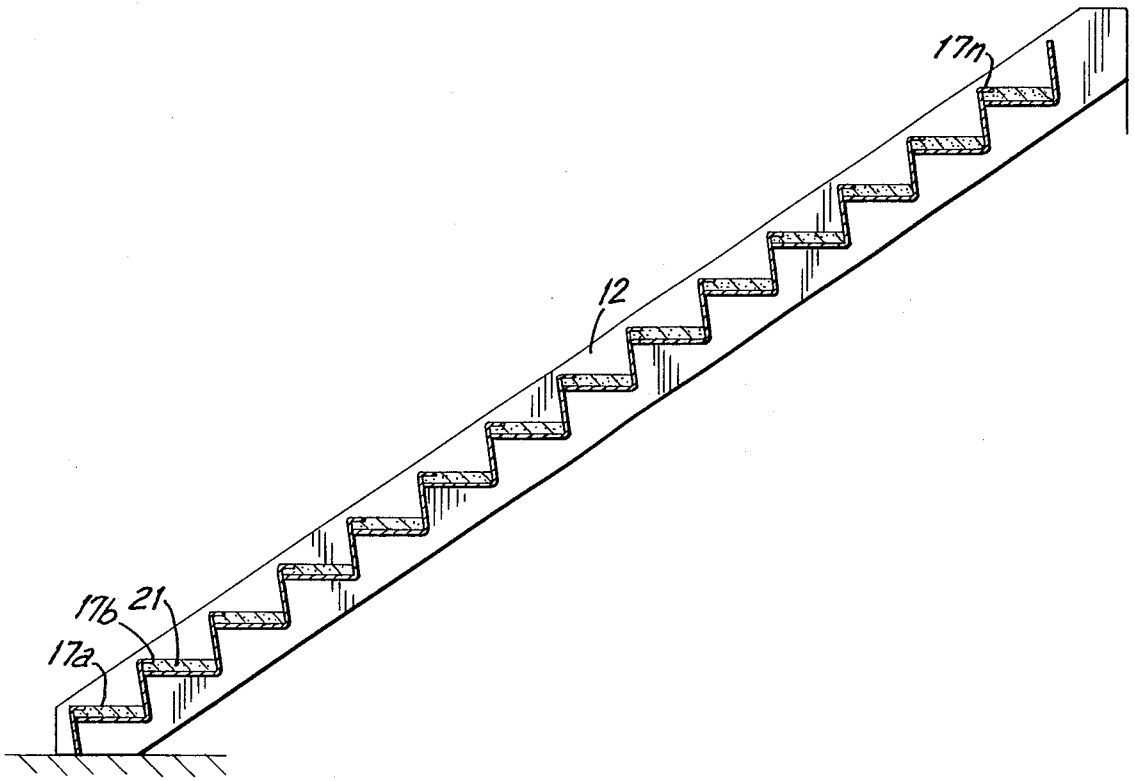
FIG. 2 is a side cross-sectional view taken along A—A of FIG. 1.
Figure 1:
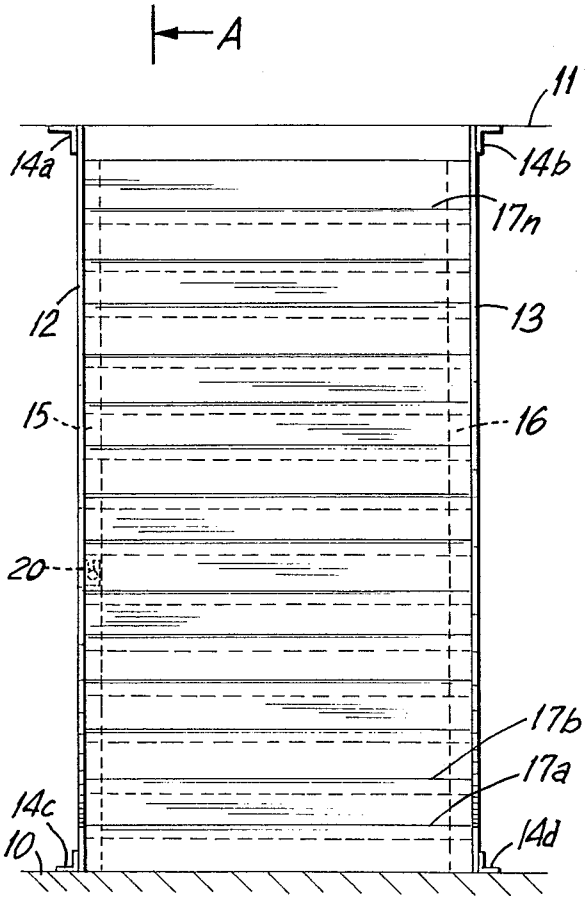
FIG. 1 is a front plan view of the staircase of the present invention.
Figure 3:
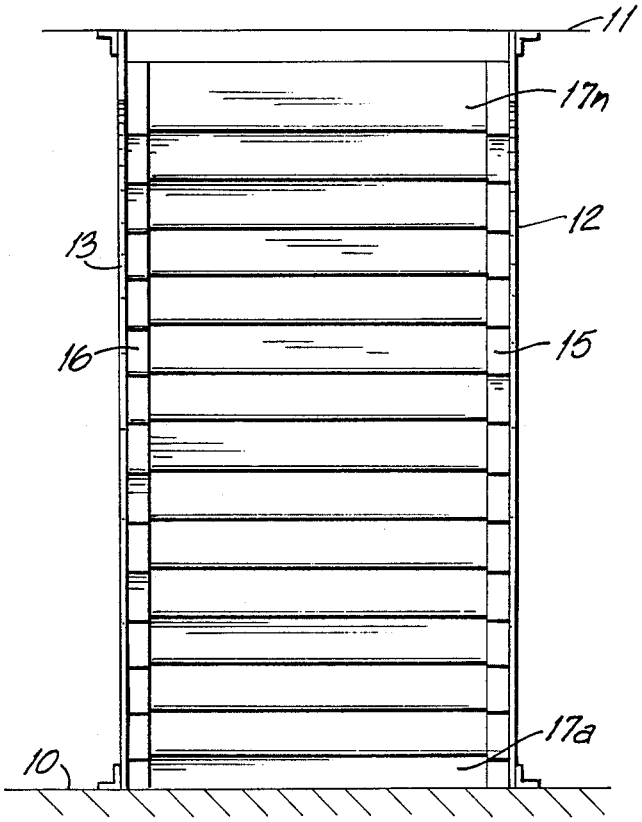
FIG. 3 is a rear plan view of the staircase of FIG. 1.

As shown in FIGS. 1–3, the complete stairway of the present invention is a series of steps from lower floor 10 to upper floor level 11

The first step, in erection of the stairway, shown in FIG. 1, is to clamp the two steel stringers 12,13 (side members) to the floors 10 and 11 with the stringers 12,13 spaced apart the correct width. As shown, such clamping may use L brackets **14*a*–14*d***.

Each of the stringers has steel side brackets 15,16, respectively, welded thereon. The brackets 15,16 are welded to the stringers off-site at the metal fabrication shop. The details of the brackets 15,16 are shown in FIGS. 4–7. The brackets 15,16 are the ledges which support the steel stair pans.

After the stringers 12,13 are clamped in place, the stair pans **17*a*–17*n* are placed in location resting on the two series of side brackets 15–16. The lowest (first) stair pan 17*a* is placed on the brackets 15,16, then the next stair pan 17*b* is placed in its position, step-by-step, until the final stair pan 17*n* is placed in position. At this time the nuts are hand-tightened. The staircase is now sufficiently stable so that it may be walked upon by the workers who are tightening the nuts. The stair pans are located in their final aligned position by driving the wedges 20. The nuts are then tightened, for example, by a socket wrench. The staircase is now completely assembled and may be used by the construction workers. At any convenient time the stair pans are filled with concrete 21**. The last step is to touch-up the concrete and fasten the ends of stringers, which completes the staircase.

Figure 4:
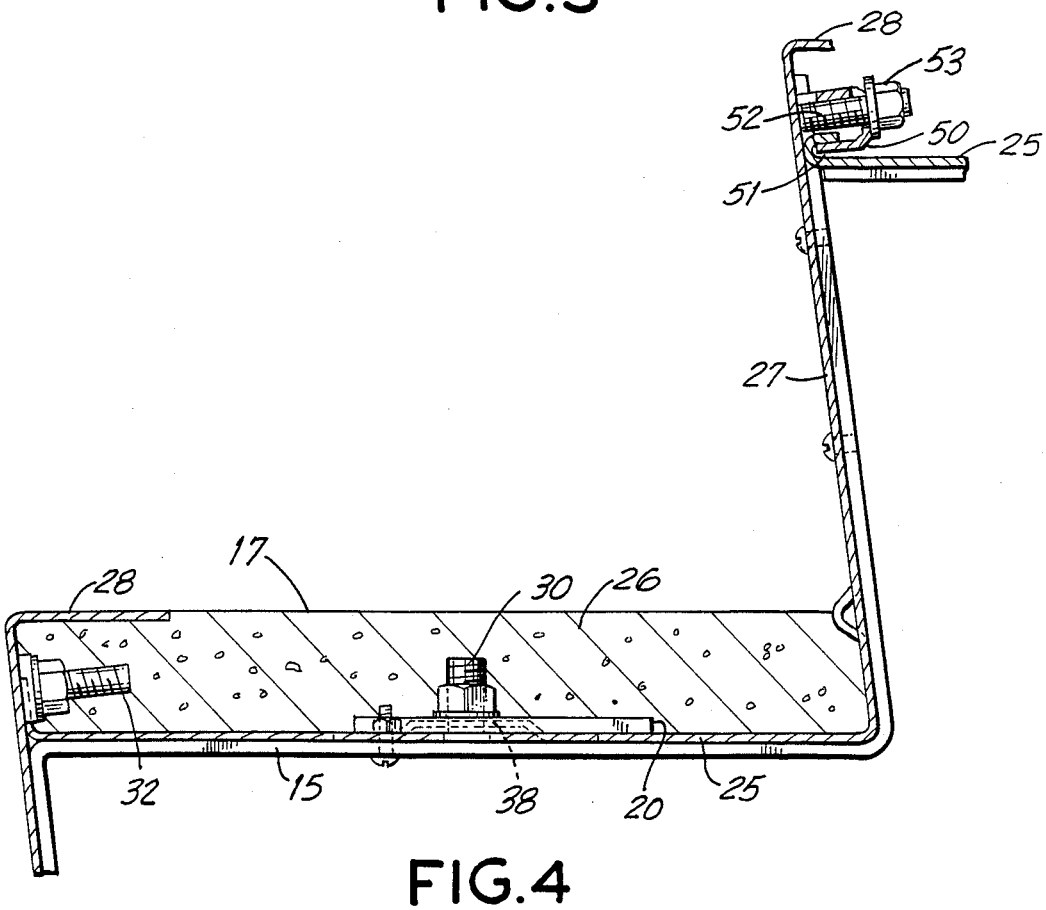
FIG. 4 is a side cross-sectional view, enlarged, taken along D—D of FIG. 1.

As shown in FIG. 4, the stair pan 17 is bent from sheet metal and comprises a flat horizontal pan portion 25 which supports the pad 26, a riser portion 27, which may be within 15 degrees of being vertical, and a nose portion 28, which is horizontal and forms an edge for the concrete pad. Each stair pan 17 is secured to the side brackets 15,16 by four bolts 30–33, two on each side of the stair pan. The first pair of bolts 30,31 and the second pair of bolts 32,33 are welded to the brackets 15,16 and their nuts are shipped threaded near the outer free ends of the bolts.

The bolts 30,31 act as fixed pins to their associated wedges. The wedges are used to draw the stair pans into a tight junction and in accurate alignment with the side stringers 12,13. The bolts 32,33 hold the top of the riser portion 27, one on each side, near the edge of the stair pan. The bolts 30,31 are vertical and the bolts 32,33 are horizontal.

Figure 9:
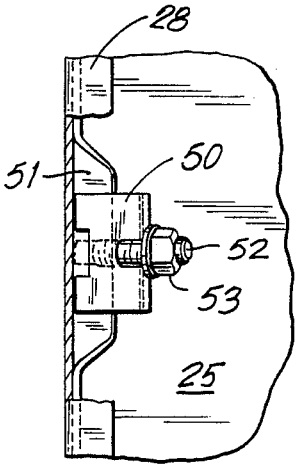
FIG. 9 is a top plan view of the clip.

In addition, a bolt 35 is used to support the riser portion and lip portion, as is explained below in connection with FIGS. 4 and 9.

Figure 5:
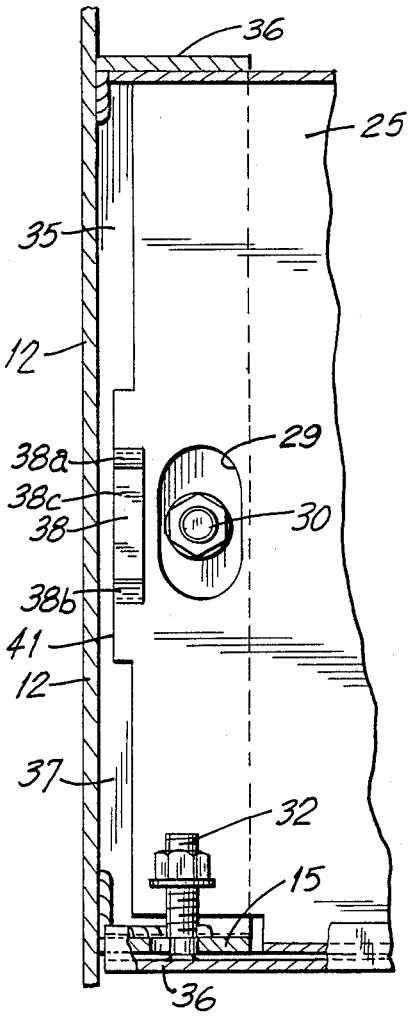
FIG. 5 is a top plan view, enlarged, of one side of the stair of the staircase of FIG. 1, before the cement is poured and before the stair pan is tightened in its position.

As shown in FIG. 5, the bracket 15 has two bolts 30,32 to hold one side of each stair pan. FIG. 1 shows the stringer 12 and its bracket 15 with one stair pan. The bracket 15 consists of a series of vertical portions 35 and horizontal portions 36. The bolt 30 is welded to horizontal portion 35 and the bolt 32 is welded to vertical portion 35. When a stair pan is first placed in position, there is a gap 37 between the edge of the stair pan and the stringer 12.

Figure 10:
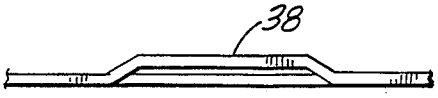
FIG. 10 is a side view of the lance portion of the stair pan.

Each stair pan has two raised lance portions 38, one near each side edge. Each lance portion 38 has two opposed legs 38*a*,38*b* and a top member 38*c*, see FIG. 10. The lance portion 38 forms a solid surface against which the wedge 20 cams. If the pan were bent-up to form a surface, instead of lance portion 38, the wedge would be likely to bend such a bent surface backwards instead of camming the stair pan.

Figure 6:
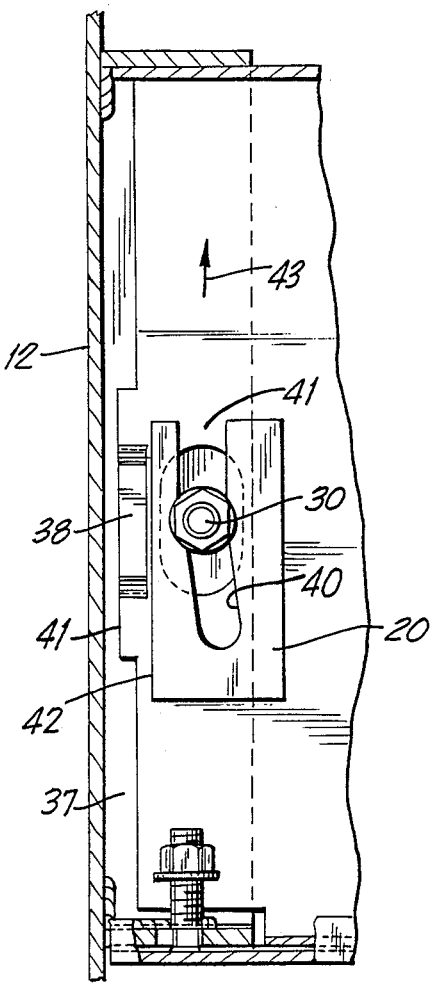
FIG. 6 is a top plan view, similar to FIG. 5, but with the wedge in its initial position.
Figure 7:
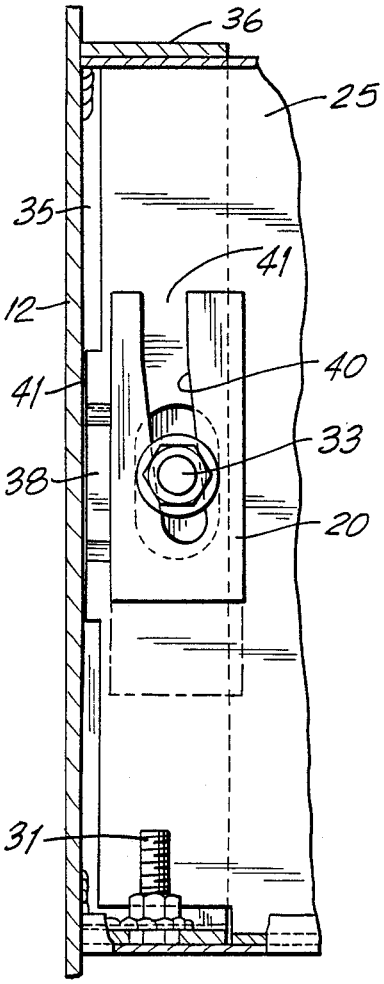
FIG. 7 is a top plan view, similar to FIG. 6, but with the wedge in its final position.

As shown in FIGS. 5–7, the wedge 20 is a flat rectangular steel plate member having an elongated slit 40 with an open mouth 41. The open mouth 41 is placed over the shaft of the bolt 30. The wedge slit 40 is angled relative to the wedge side 42. When the wedge 20 is driven in the direction of arrow 43 the side 42 of the wedge is forced to cam against the side of lance 38, driving the lance 38, and the stair pan to which it is connected, to the left (as shown in FIGS. 6 and 7). The bolt is fixed, and the slit 40 is angled, so that as the wedge 20 is driven in the direction of the arrow 43, it enlarges the space between the bolt 30 and the lance 38. The gap 37 will be reduced to zero, at the unindented center 41, as the wedge is driven upward.

Figure 8:
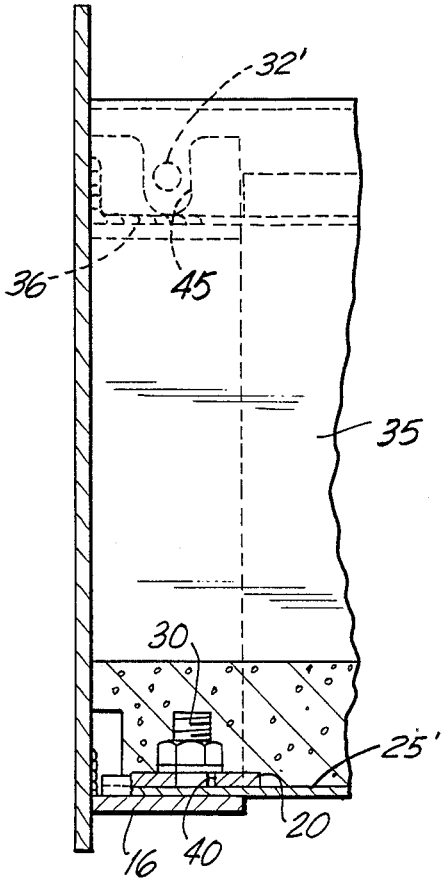
FIG. 8 is a front cross-sectional view of the staircase portion shown in FIG. 7 but after the nut is tightened and the concrete is in place.

The bolt 30 protrudes through an elongated hole 29 in the horizontal stair pan portion 25. As shown in FIG. 8, the corresponding stair pan portion 25′, of the next higher stair, has a vertical open mouth slot 45 to receive the bolt 32′. The stair pan is tilted, when being positioned so that its slot 45 fits beneath the nut on bolt 32′. That slot construction, shown in FIG. 8, is found in both sides of the stair pan and in each stair pan.

The stair pan is relatively wide; for example, it may be four or five feet wide. Unless it is supported in the center, its nose portion 28 may be depressed or broken when walked upon before the pan is filled with cement. As shown in FIGS. 4 and 9, a clip 50 is used to support the center of the nose portion 28. The clip 50, which is generally C-shaped, has a leg which fits within channel 51. The channel 51 is formed by bending back the metal, for the width of a few inches, at the center of the stair pan, along the edge of the nose portion 28. A bolt 52, welded to the riser portion of the stair pan, has a nut 53 which is used to tighten the clip 50 into the channel 51.

I claim:

1. A bolted metal staircase including a pair of spaced apart and parallel side stringers, a plurality of horizontally aligned carrier brackets fastened to each stringer, and a plurality of stair pans, each of said stair pans having a horizontally aligned pan portion; characterized in that:

a pair of upwardly protruding lance means are formed on said pan portions, each lance means being near an outer edge of said pan portion and proximate said stringers;

a vertically aligned bolt having a shank portion is positioned on said bracket;

a flat plate wedge having a side face and a slit angled relative to said side face is positioned on said pan portion with said bolt shank portion within said slit and with said wedge side face in contact with said lance means to cam said pan portion toward said stringer as said wedge is driven parallel to said outer edge of the pan portion.

2. A bolted metal staircase as in claim 1 wherein said lance means comprises a protruding portion stamped from said pan portion and having opposite support legs and a top portion.

3. A bolted metal staircase as in claim 1 wherein each of said stair pans further comprises an integral riser portion and a plurality of vertical brackets fastened to each stringer and each having a horizontally aligned bolt welded thereto, each of said riser portions being fastened to two opposite-side vertical brackets by nuts threaded on said horizontal bolts.

4. A bolted metal staircase as in claim 1 wherein said pan portion outer edge is a protruding portion of said pan portion.

5. A bolted metal staircase including a pair of spaced apart and parallel side stringers, a plurality of horizontally aligned carrier brackets fastened to each stringer, and a plurality of stair pans, each of said stair pans having a horizontally aligned pan portion and an integral riser portion, characterized in that:

a lip forming a channel is integral with each of the said pan portion and at the free edge thereof;

an upwardly protruding shoulder means is formed on each of said pan portions near the two outer edges of each of said pan portions and proximate said stringers;

a pair of bolts each having a shank portion are vertically secured on said brackets;

a pair of wedge means each having a side face and a slit angled relative to said edge are positioned on each of said pan portion with a bolt shank portion with each slit and with each of said wedge means against one of said shoulder means to cam each of said pan portions toward the stringers as said wedge means is driven parallel to an outer edge of the pan portion; and a clamp having a leg thereon is engaged in each of said lip channels and connects said lip to the riser of another stair pan.

6. A metal staircase as in claim 5 wherein said clamp is a C-shaped clamp and a bolt fixed near the top edge of a riser connects said riser portion and said lip through the engagement of the clamp leg in the lip channel.

7. The method of installing a bolted metal staircase having a pair of spaced apart and parallel side stringers, a plurality of horizontally aligned carrier brackets fastened to each stringer having bolts fastened thereon with nuts on said bolts, a plurality of stair pans, each of said stair pans having a horizontally aligned pan portion with holes for said bolts; each of said pan portions having a pair of upwardly protruding shoulder means formed near the outer edges thereof and proximate said stringers; and a plurality of flat plate wedges, each wedge having a side face and a slit angled relative to said side face, each wedge being positioned on said pan portion and with said bolt within said slit and with said wedge side face against said shoulder means;

the method comprising the steps, in order, of: erecting said stringers, positioning said stair pans on said brackets, hand-tightening said nuts, driving each of said wedges parallel to said respective outer edge of the pan portion to cam said wedge side face against said shoulder member and thereby drive said pan portion toward said stringer, and further tightening said nuts.

* * * * *